US007514674B2

(12) United States Patent
Glish et al.

(10) Patent No.: US 7,514,674 B2
(45) Date of Patent: Apr. 7, 2009

(54) OCTAPOLE ION TRAP MASS SPECTROMETERS AND RELATED METHODS

(75) Inventors: Gary L. Glish, Chapel Hill, NC (US); Desmond Kaplan, Durham, NC (US)

(73) Assignee: The University of North Carolina at Chapel Hill, Chapel Hill, NC (US)

( * ) Notice: Subject to any disclaimer, the term of this patent is extended or adjusted under 35 U.S.C. 154(b) by 134 days.

(21) Appl. No.: 11/579,569

(22) PCT Filed: May 4, 2005

(86) PCT No.: PCT/US2005/015702

§ 371 (c)(1),
(2), (4) Date: Jul. 9, 2007

(87) PCT Pub. No.: WO2006/083264

PCT Pub. Date: Aug. 10, 2006

(65) Prior Publication Data

US 2008/0111067 A1 May 15, 2008

Related U.S. Application Data

(60) Provisional application No. 60/567,916, filed on May 4, 2004.

(51) Int. Cl.
*H01J 49/42* (2006.01)

(52) U.S. Cl. ..... 250/282; 250/292; 250/281; 250/290; 250/293

(58) Field of Classification Search ..... 250/282, 250/292, 281, 290, 293
See application file for complete search history.

(56) References Cited

U.S. PATENT DOCUMENTS 7,232,993 B1 * 6/2007 Specht et al. ..... 250/292
7,456,396 B2 * 11/2008 Quarmby et al. ..... 250/292

OTHER PUBLICATIONS

International Search Report and Written Opinion dated Oct. 6, 2006.
International Preliminary Examination Report on Patentability dated Nov. 16, 2006.

* cited by examiner

*Primary Examiner*—Nikita Wells
(74) *Attorney, Agent, or Firm*—Jenkins, Wilson, Taylor & Hunt, P.A.

(57) ABSTRACT

A mass spectrometer according to one embodiment can include first and second endcap electrodes, first and second outer ring electrodes, and a central ring electrode. The first outer ring electrode can be positioned downstream of the first endcap electrode. The central ring electrode can be positioned downstream of the first outer ring electrode. The second outer ring electrode can be positioned downstream of the central ring electrode. The second endcap electrode can be positioned downstream of the second outer ring electrode. The mass spectrometer can also include a radio frequency (RF) signal supply operable to apply an RF signal to the first and second outer ring electrodes to thereby generate a substantially octapolar field for trapping charged particles.

102 Claims, 13 Drawing Sheets

OCTAPOLE ION TRAP MASS SPECTROMETERS AND RELATED METHODS

CROSS-REFERENCE TO RELATED APPLICATION

This nonprovisional application claims the benefit of U.S. Provisional Application No. 60/567,916, filed May 4, 2004, the disclosure of which is incorporated by reference herein in its entirety.

GRANT STATEMENT

The subject matter disclosed herein was supported by NIH grant GM49852. Thus, the Government has certain rights in the subject matter disclosed herein.

TECHNICAL FIELD

The subject matter disclosed herein relates to mass spectrometry. More particularly, the subject matter disclosed herein relates to octapole ion trap mass spectrometers and related methods.

BACKGROUND ART

Mass spectrometry allows the determination of the mass-to-charge ratio (m/z) of ions of sample molecules. This technique involves ionizing the sample molecule or molecules and then analyzing the ions in an analyzer and detecting the analyzed ions. Various mass spectrometers are known.

Tandem mass spectrometry is an exemplary use of a mass spectrometer to gain structural information about the sample molecule or molecules. This common type of spectrometry includes generating sample ions, subjecting the ions to a first stage of mass analysis, reacting one or more of the ions (referred to as parent ions) analyzed in the first stage of mass spectrometry, and then analyzing the ions that are products of the reaction (products ions) with the second stage of mass analysis and detecting the analyzed ions. The ion trap can be utilized for selecting parent ions of a desired mass-to-charge ratio (m/z) for analysis. The parent ions are then dissociated into product ions, which may be analyzed by the same mass analyzer to determine the mass-to-charge ratios of the products ions and obtain a mass spectrum of the products ions.

Recently, the desire for improved ion trap performance has led to further exploration of higher order field components. Most notably has been the introduction of small amounts of octapole and hexapole higher order field components to the quadrupole ion trap. Because of the inherent asymmetry, hexapole fields improve ejection efficiency thus enhancing the sensitivity of a quadrupole ion trap. Increasing the octapole electric field component in a quadrupole ion trap has been used to correct for the electric field deformation caused by the opening in the endcap electrodes, which enhances the mass accuracy and resolution of the quadrupole ion trap. An additional advantage of octapole fields is an improvement in the efficiency of tandem mass spectrometry due to the cross terms ($r^2z^2$) in the ions' motion within octapole fields. Although quadrupole ion traps with higher order fields have enhanced analytical performance, there still remains a desire to further improve performance with regard to sensitivity, ion detection methods, ion ejection and MS/MS efficiencies.

A typical quadrupole ion trap includes a ring electrode and two endcap electrodes each having an opening for passage of ions into or out of the trapping volume. In order to trap charged particles, the ion trap uses a dynamic voltage applied to the ring electrode and/or the endcap electrodes to confine charged particles within the trapping volume. The quadrupole ion trap is a three dimensional analog to a linear (two-dimensional) quadrupole mass filter. Both are used successfully as mass spectrometers. Two dimensional quadrupoles are also used as ion guides, to efficiently transport ions in various types of mass spectrometers. Higher order linear multipoles, such as hexapoles and octapoles, have also been used as ion guides, but never as mass spectrometers. Although quadrupole ion traps have reasonable analytical performance, there still remains a desire to further improve performance with regard to sensitivity, ion detection methods, ion ejection and MS/MS efficiencies.

Accordingly, in light of desired improvements associated with ion trapping and ejection, there exists a need for improved ion trap mass spectrometers and related methods.

SUMMARY

According to one aspect, the subject matter described herein comprises octapole ion trap mass spectrometers and related methods. One mass spectrometer according to the subject matter described herein includes first and second endcap electrodes, first and second outer ring electrodes, and a central ring electrode. The first outer ring electrode can be positioned downstream of the first endcap electrode. The central ring electrode can positioned downstream of the first outer ring electrode. The second outer ring electrode can be positioned downstream of the central ring electrode. The second endcap electrode can be positioned downstream of the second outer ring electrode. The mass spectrometer can also include a radio frequency (RF) signal supply operable to apply an RF signal to the first and second outer ring electrodes to thereby generate a octapolar field for trapping charged particles. According to one embodiment, the central ring electrode and the first and second endcap electrodes can be grounded. Alternatively, the RF signal supply can apply an RF signal to the endcap electrodes and the central electrode to thereby generate an octapolar field for trapping charged particles. In this alternative, the outer ring electrodes can be grounded.

BRIEF DESCRIPTION OF THE DRAWINGS

Preferred embodiments of the subject matter described herein will now be explained with reference to the accompanying drawing of which.

DETAILED DESCRIPTION

Octapole ion trap mass spectrometers and related methods according to embodiments of the subject matter described herein may be utilized for a variety of purposes. For example, the mass spectrometers and related methods can be utilized for the analysis of bio-molecules such as peptides and proteins, and enables the determination of amino acid sequence of peptides and proteins. Other uses of the mass spectrometers and methods described herein include detection of air pollutants, explosives, and chemical and biological warfare agents.

According to one embodiment, a mass spectrometer is provided for generating a substantially octapolar field for trapping charged particles such as ions. The generated octapolar field may not be an ideal octapolar field but can generally be characterized as being an octapolar field. The mass spectrometer can include two endcap electrodes, two outer ring electrodes, and a central ring electrode that can be arranged such that ions are moved through the interior of the electrodes. Further, the electrodes can be serially arranged in a downstream order with one another such that one of the endcap electrodes is first, one of the outer ring electrodes is second, the central ring electrode is third, the other outer ring electrode is fourth, and the other endcap electrode is fifth. As used herein, "downstream" means in a direction of flow of ions through the mass spectrometer. For example, an ion source can produce ions that flow through the electrodes in the above serial arrangement towards a detector. Conversely, "upstream" means in a direction opposite of "downstream".

A substantially octapolar electric field can be generated within the electrodes for trapping charged particles by application of a radio frequency (RF) signal to alternating electrodes and connection of the other electrodes to ground. According to one embodiment, the RF signal is applied to outer ring electrodes, and the central ring electrode and endcap electrodes are grounded. According to another embodiment, the RF signal is applied to the central ring electrode and the endcap electrodes, and the outer ring electrodes are grounded. Trapped ions can be ejected by applying an alternating current (AC) signal to two non-adjacent electrodes, such as electrodes that do not have the RF signal applied to them. Alternatively, RF signals can be applied to all the electrodes, with the phase of the RF voltage applied to each electrode being shifted 180 degrees from the adjacent electrode(s).

Figure 1:
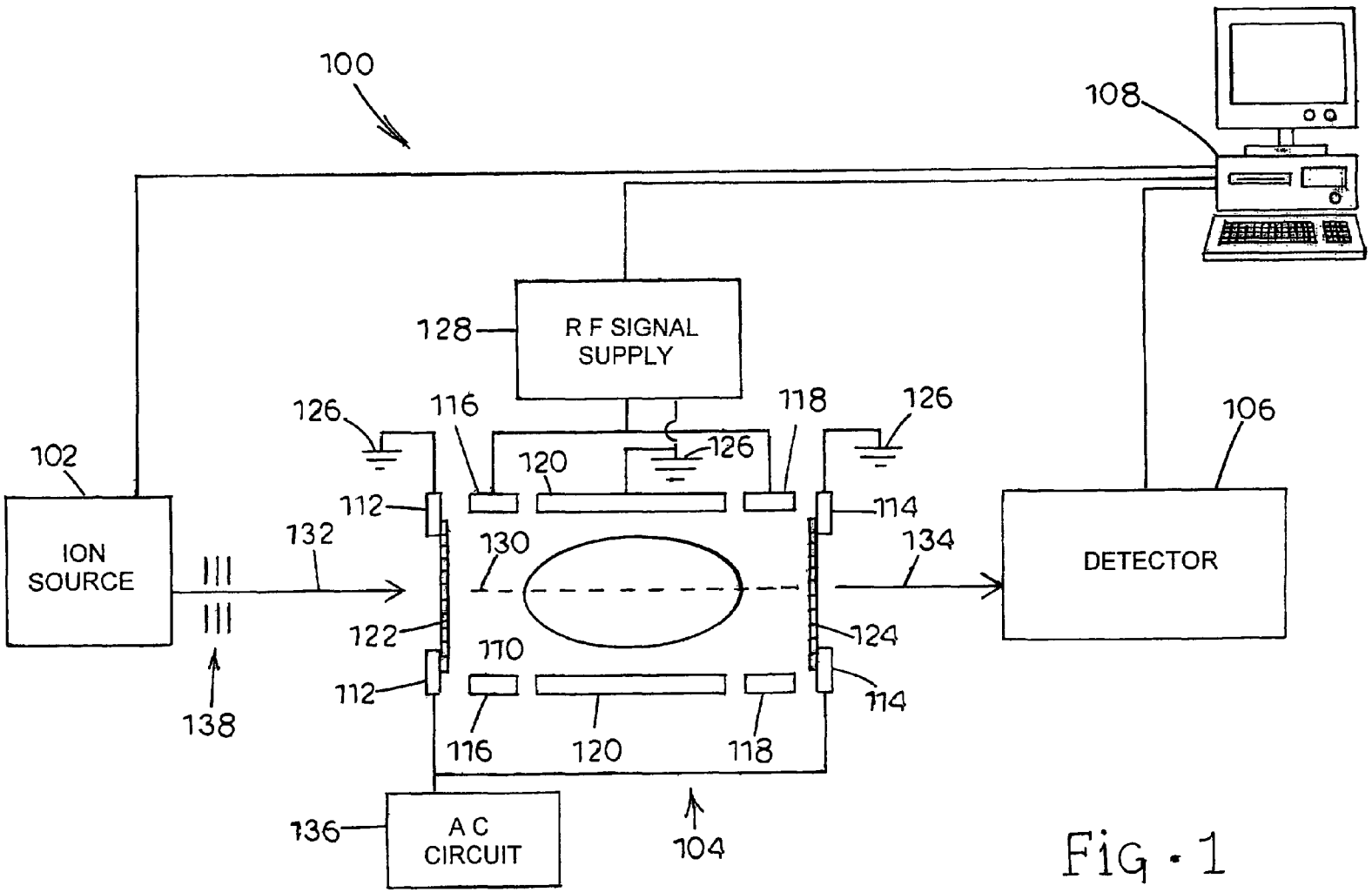
FIG. 1 is a schematic diagram of an exemplary mass spectrometer according to one embodiment of the subject matter described herein.

FIG. 1 illustrates a schematic diagram of an exemplary mass spectrometer, generally designated 100, according to one embodiment of the subject matter described herein. Mass spectrometer 100 can include an ion source 102, an octapole ion trap (OIT) (generally designated 104 and shown as a vertical cross-sectional side view), a detector 106, and a computer 108. Mass spectrometer 100 can operate to generate and alter an octapolar electric field within OIT 104 for trapping ions within a volume 110 (illustrated in cross-section as an elliptical shape). The RF voltage applied to the OIT 104 electrodes can also be altered such that the trajectories of simultaneously trapped ions of consecutive mass/charge ratio (m/z) become sequentially unstable, and the ions leave the trapping field in order of mass/charge ratio. Upon ejection from OIT 104, ions can strike detector 106 and provide an output signal. The output signal can be communicated to computer 108 for analysis and display to an operator.

In the embodiment shown in FIG. 1, OIT 104 is a cylindrical octapole ion trap (COIT). Alternatively, other suitable shapes can be utilized. OIT 104 can include endcap electrodes 112 and 114, outer ring electrodes 116 and 118, and central ring electrode 120. The electrodes can define an interior within which an electric field closer to a pure octapole electric field is generated. According to one embodiment, the inner surface of the electrodes may have a hyperbolic shape, and the outer ring electrodes can have a smaller interior radius than the central ring electrode. The relative spacing and interior radii of the central ring electrode can be determined from the following equation (wherein $R_{CRE}$ is the interior radii of the central ring electrode, and $z_0$ is the spacing between the central ring electrode and an endcap electrode along the z axis):

$$R_{CRE} \approx 1.28 * z_0$$

The relative spacing and interior radii of the outer ring electrodes can be determined from the following equation (wherein $R_{ORE}$ is the interior radii of the outer ring electrode, and $z_0$ is the spacing between the outer ring electrode and an endcap electrode along the z axis):

$$R_{ORE} \approx 1.24 * z_0$$

According to one embodiment of the hyperbolic shape of the interior of the electrodes, the polar angle from the center of the ion trap to the tip of the radius of the outer electrode can be equal to arccosine $$\left(\sqrt{\frac{3}{7}}\right).$$

Endcap electrodes 112 and 114 can include an opening covered with wire mesh 122 and 124 respectively, through which ions may be injected or ejected from the interior of OIT 104. Mesh 122 and 124 can provide a uniform electric field such that the ions are affected by as limited fringe fields as possible upon injection into OIT 104. According to one embodiment, mesh 122 and 124 may be an 88% transmission, nickel (Ni)-plated mesh.

Endcap electrodes 112 and 114, outer ring electrodes 116 and 118, and central ring electrode 120 can be used for generating a substantially octapole electric field within OIT 104. According to one embodiment, the substantially octapole electric field can be generated by application of a radio frequency (RF) voltage to outer ring electrodes 116 and 118 and the connection of central ring electrode 120 to a ground 126. Alternatively, ions can be ejected by applying the supplemental AC voltage to one of the endcap electrodes 112 and 114 and central ring electrode 120. The RF voltage can be generated by an RF signal supply 128, which can be controlled by computer 108. Endcap electrodes 112 and 114 are also connected to ground 126.

In order to trap charged particles, the RF voltage applied to outer ring electrodes 116 and 118 generates an electric field to confine charged particles axially in a z direction, which is along a z axis 130 (shown with broken lines) between openings of endcap electrodes 112 and 114. The generated electric field also confines charged particles radially, i.e., in x and y directions perpendicular to z axis 130. Endcap electrodes 112 and 114, outer ring electrodes 116 and 118, and central ring electrode 120 may be in any suitable shape that allows trapping of the desired particles with OIT 104.

Ion source 102, endcap electrodes 112 and 114, outer ring electrodes 116 and 118, central ring electrode 120, and detector 106 can be arranged coaxially along the axis of the center of the generated electric field and the center of the openings of endcap electrodes 112 and 114. Arrow 132 generally illustrates the direction of ions entering OIT 104. Ions ejected by OIT 104 are generally illustrated by arrow 134. The ions can be ejected from OIT 104 by application of a supplemental AC voltage to endcap electrodes 112 and 114 from an AC circuit 136 and isolation of endcap electrodes 112 and 114 to ground 126. Endcap electrodes 112 and 114 may be grounded through a Balun transformer (not shown) when the AC voltage is not being applied.

In one embodiment, the ions can be ejected from OIT 104 by application of a supplemental AC voltage to central ring electrode 120 and one of endcap electrode 112 or endcap electrode 114. The one of endcap electrode 112 or endcap electrode 114 which does not have the AC voltage applied is grounded. In this embodiment, AC circuit 136 can be connected to central ring electrode 120 and one of endcap electrode 112 or endcap electrode 114 for application of the supplemental AC voltage.

Figure 2:
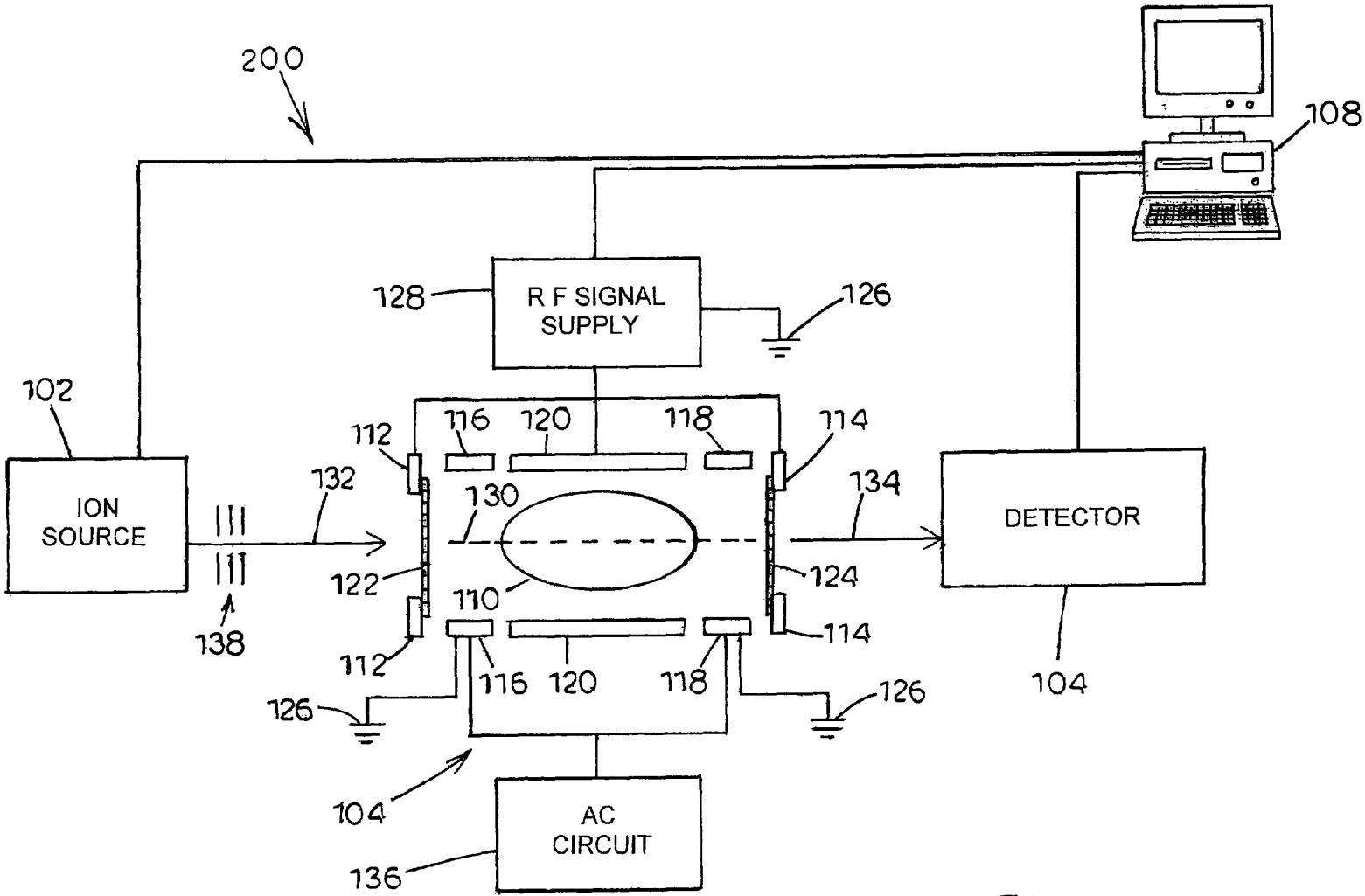
FIG. 2 is another exemplary mass spectrometer according to an embodiment of the subject matter described herein.

According to another embodiment of the subject matter described herein, a substantially octapole electric field can be generated within OIT 104 by application of an RF voltage to central ring electrode 120 and endcap electrodes 112 and 114. FIG. 2 illustrates another exemplary mass spectrometer, generally designated 200, having RF signal supply 128 connected to central ring electrode 120 and endcap electrodes 112 and 114 according to an embodiment of the subject matter described herein. Further, outer ring electrodes 116 and 118 may be grounded by connection to ground 126. In this embodiment, ions trapped within OIT 104 can be ejected by application of a supplemental AC voltage to outer ring electrodes 116 and 118 by AC circuit 136 and isolation of outer ring electrodes 116 and 118 to ground 126. The supplemental AC voltage is applied when ions are being ejected and when tandem mass spectrometry using collision induced dissociation is being performed.

FIGS. 3A-3H illustrate different views of OIT 104 and its components according to one embodiment of the subject matter described herein. In this embodiment, OIT 104 is generally cylindrical in shape. Alternatively, other suitable shapes may be utilized. In addition, the interior width of electrodes 112, 114, 116, 118, and 120 are as shown having a flat surface. Alternatively, the interior surface of electrodes 112, 114, 116, 118, and 120 may be hyperbolic in shape or any other suitable surface shape. Further, in the alternative, outer ring electrodes 116 and 118 may have a smaller radius than central ring electrode 120.

Figure 3A:
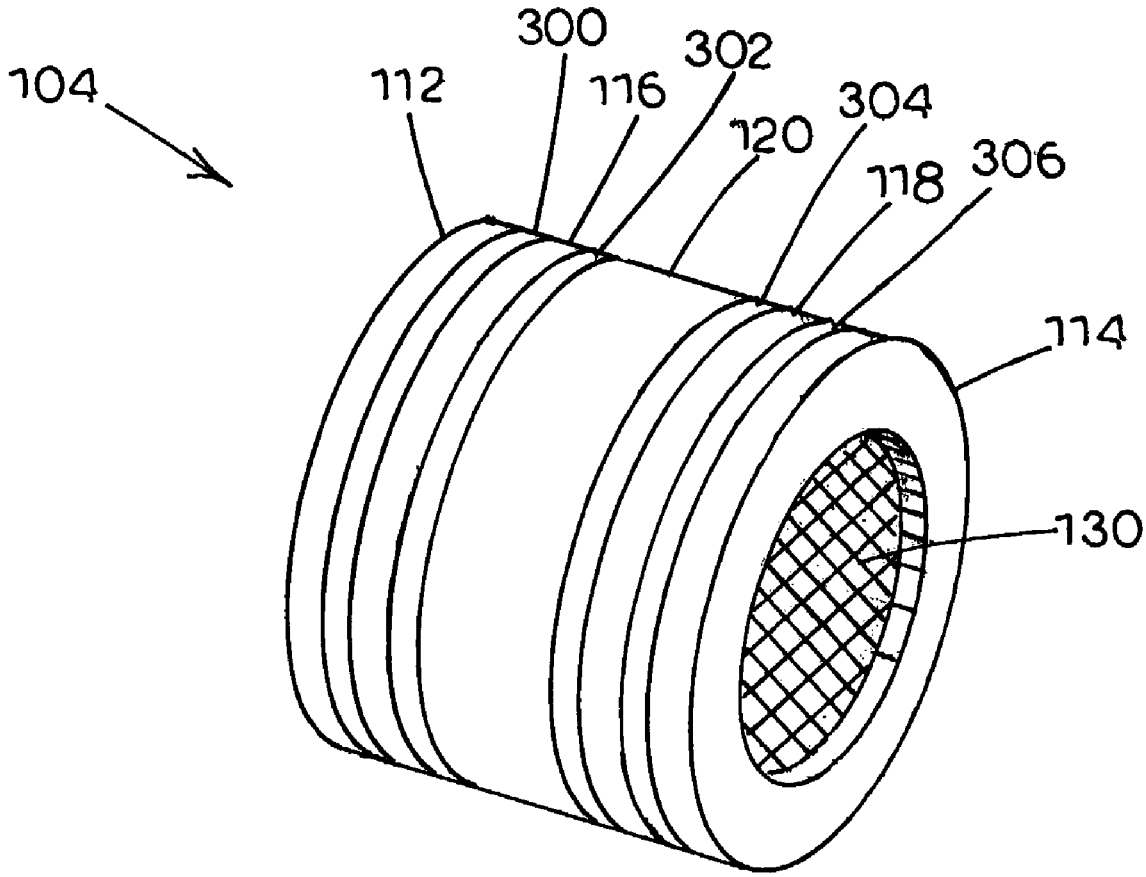
FIG. 3A is a perspective side view of an octapole ion trap (OIT) according to an embodiment of the subject matter described herein.

Referring to FIG. 3A, a perspective side view of OIT 104 according to an embodiment of the subject matter described herein is illustrated. OIT 104 can include ceramic spacers 300-306 for spacing electrodes 112-120. In particular, spacer 300 can space electrodes 112 and 116, spacer 302 can space electrodes 116 and 120, spacer 304 can space electrodes 118 and 120, and spacer 306 can space electrodes 112 and 116. Spacers 300-306 may be composed of any suitable non-conductive material for conductively isolating the electrodes from each another.

Figure 3B:
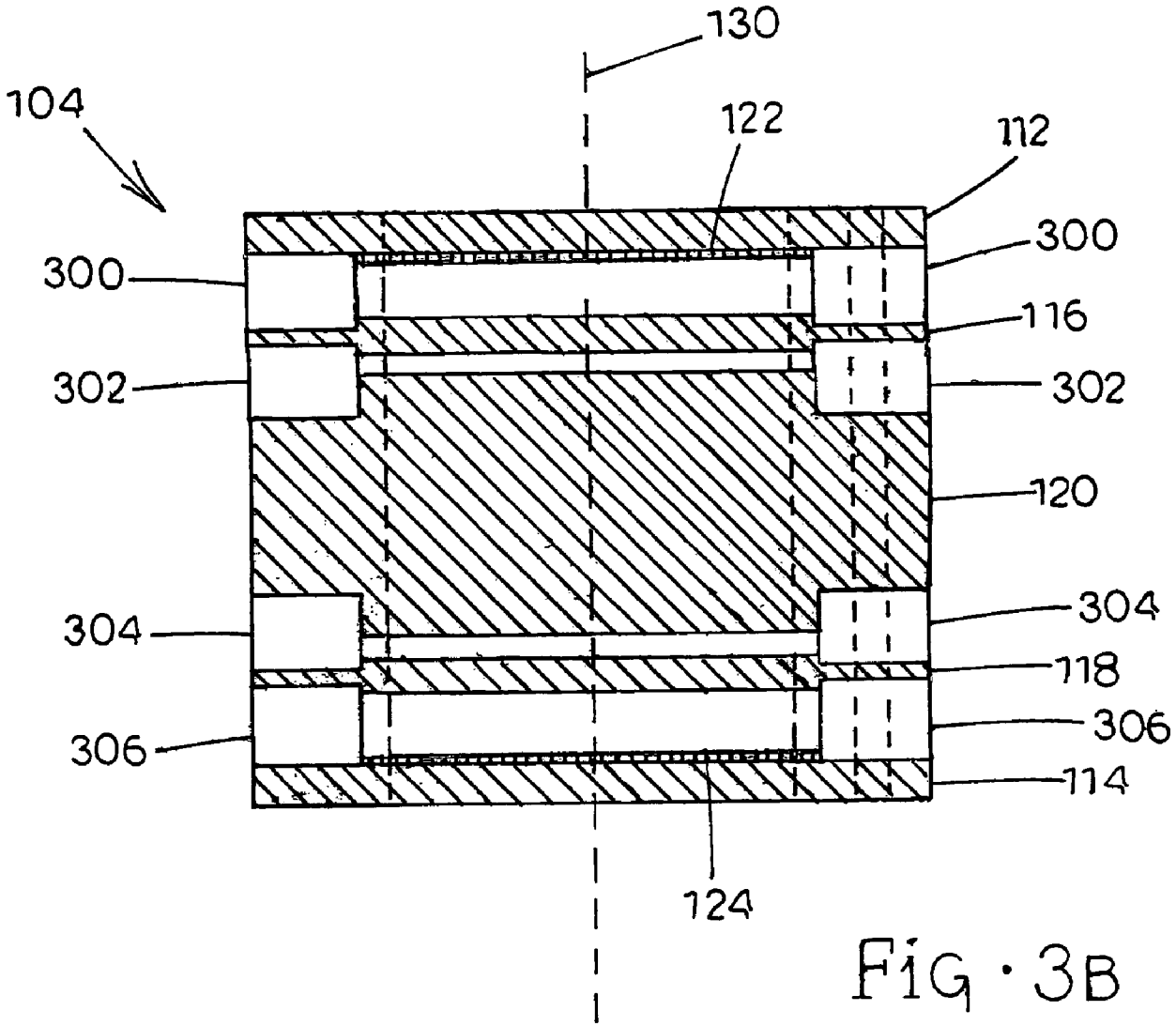
FIG. 3B is a vertical side view of the OIT of FIG. 3A.

FIG. 3B illustrates a vertical side view of OIT 120. Referring to FIG. 3B, electrodes 112, 114, 116, 118, and 120 are generally cylindrical in shape and each include a center axis aligned with one another and with z axis 130. Further, OIT 120 can include a plurality of openings extending through each of electrodes 112, 114, 116, 118, and 120 and spacers 300, 302, 304, and 306 for receiving ceramic alignment rods. For example, OIT 104 can include an opening 308 to receive a rod for aligning electrodes 112, 114, 116, 118, and 120 and spacers 300, 302, 304, and 306 and holding these components together. Mesh 122 and 124 are not shown to scale with proportion to the other components of OIT 120 in this figure.

Figure 3C:
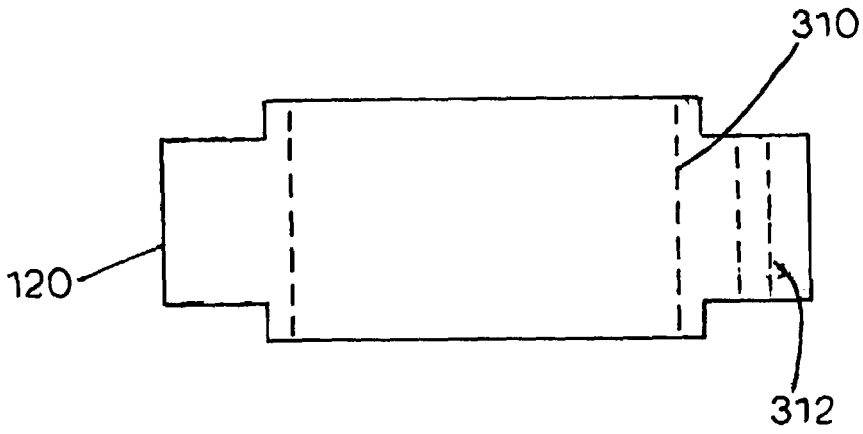
FIG. 3C is a vertical side view of a central ring electrode of the OIT of FIGS. 3A and 3B.
Figure 3D:
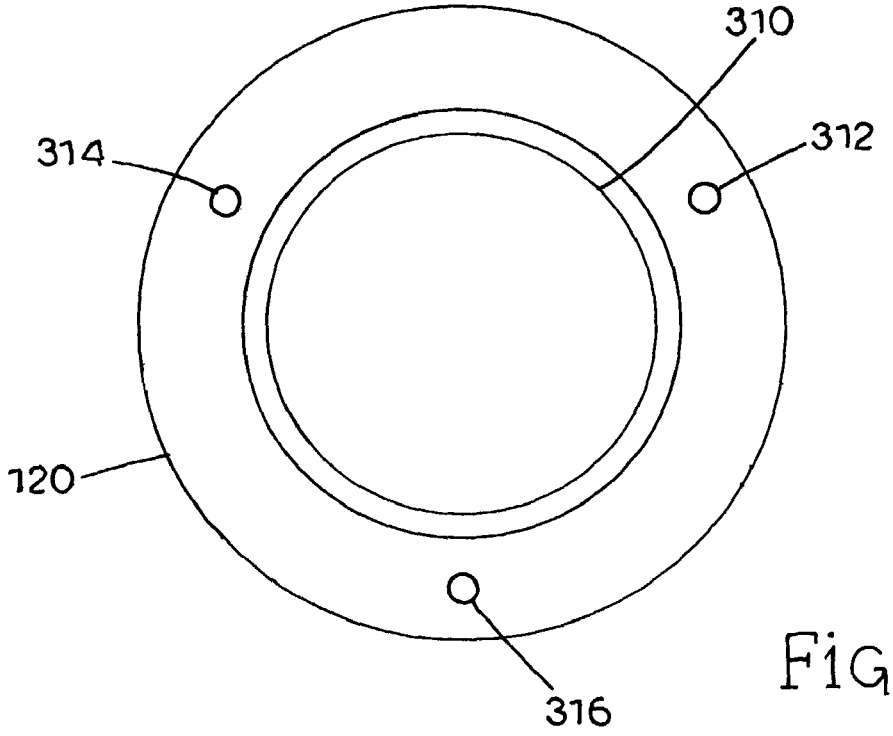
FIG. 3D is a top plan view of the central ring electrode of FIG. 3C.

FIGS. 3C and 3D illustrate a vertical side view and a top plan view, respectively, of central ring electrode 120. Central ring electrode 120 can include an opening 310 for forming a portion of the interior of OIT 104. The center of opening 310 may be aligned with z axis 130 of OIT 104. Further, central ring electrode 120 can include other openings 312, 314, and 316 for receiving alignment rods. Central ring electrode 120 can have a length (along its center axis) of 0.984 inches and a width of 2.625 inches. Further, central ring electrode 120 can be composed of stainless steel. Alternatively, central ring electrode 120 can be made of any other suitable materials and have any other suitable dimensions and shapes.

Figure 3E:
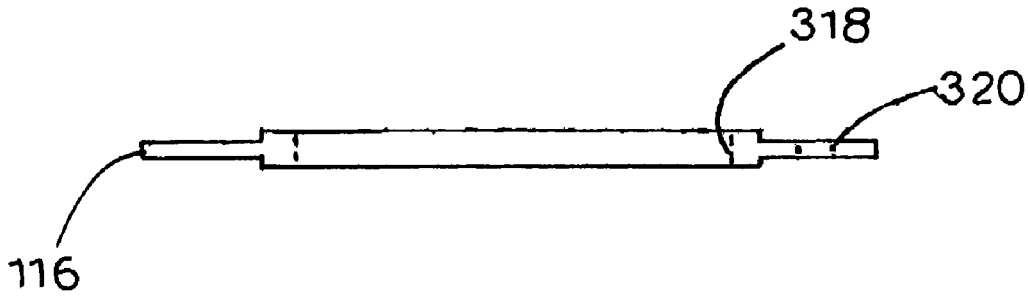
FIG. 3E is a vertical side view of an outer ring electrode of the OIT of FIGS. 3A and 3B.
Figure 3F:
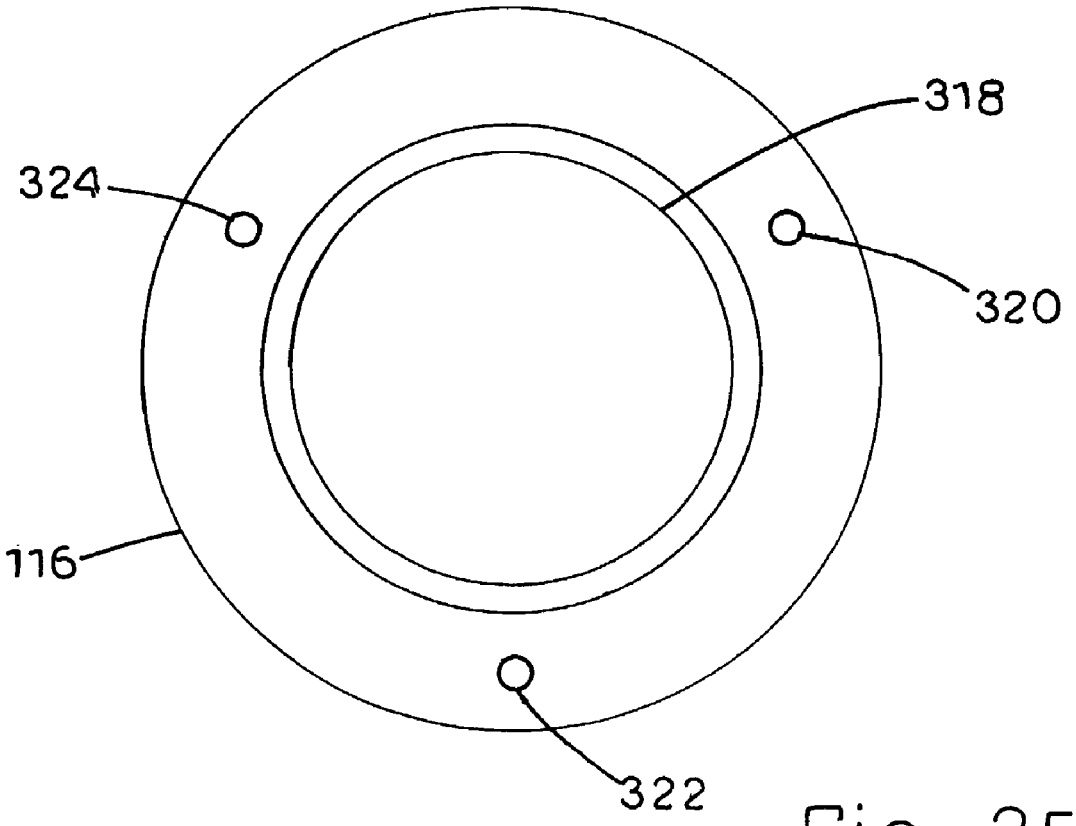
FIG. 3F is a top plan view of the outer ring electrode of FIG. 3E.

FIGS. 3E and 3F illustrate a vertical side view and a top plan view, respectively, of outer ring electrode 116. Outer ring electrode 118 can have the same dimensions and shape as outer ring electrode 116. Outer ring electrode 116 can include an opening 318 for forming a portion of the interior of OIT 104. The center of opening 318 may be aligned with z axis 130 of OIT 104. Further, outer ring electrode 116 can include other openings 320, 322, and 324 for receiving alignment rods. Outer ring electrode 116 can have a length (along its center axis) of 0.138 inches and a width of 2.625 inches. Further, outer ring electrode 116 can be composed of stainless steel. Alternatively, outer ring electrode 116 can be made of any other suitable materials and have any other suitable dimensions and shapes.

Figure 3G:
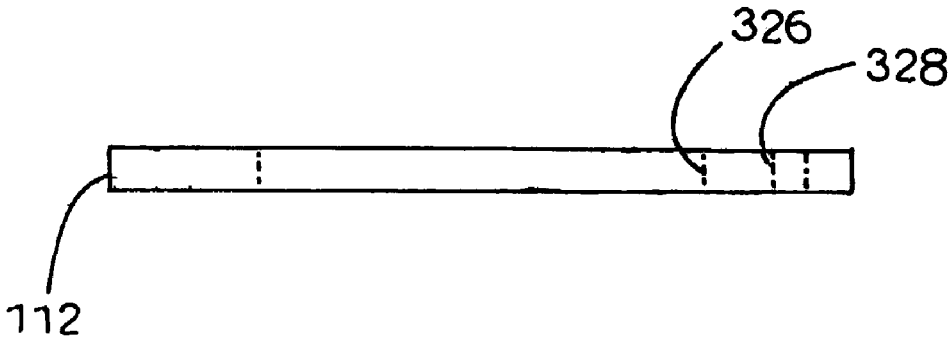
FIG. 3G is a vertical side view of an endcap electrode of the OIT of FIGS. 3A and 3B.
Figure 3H:
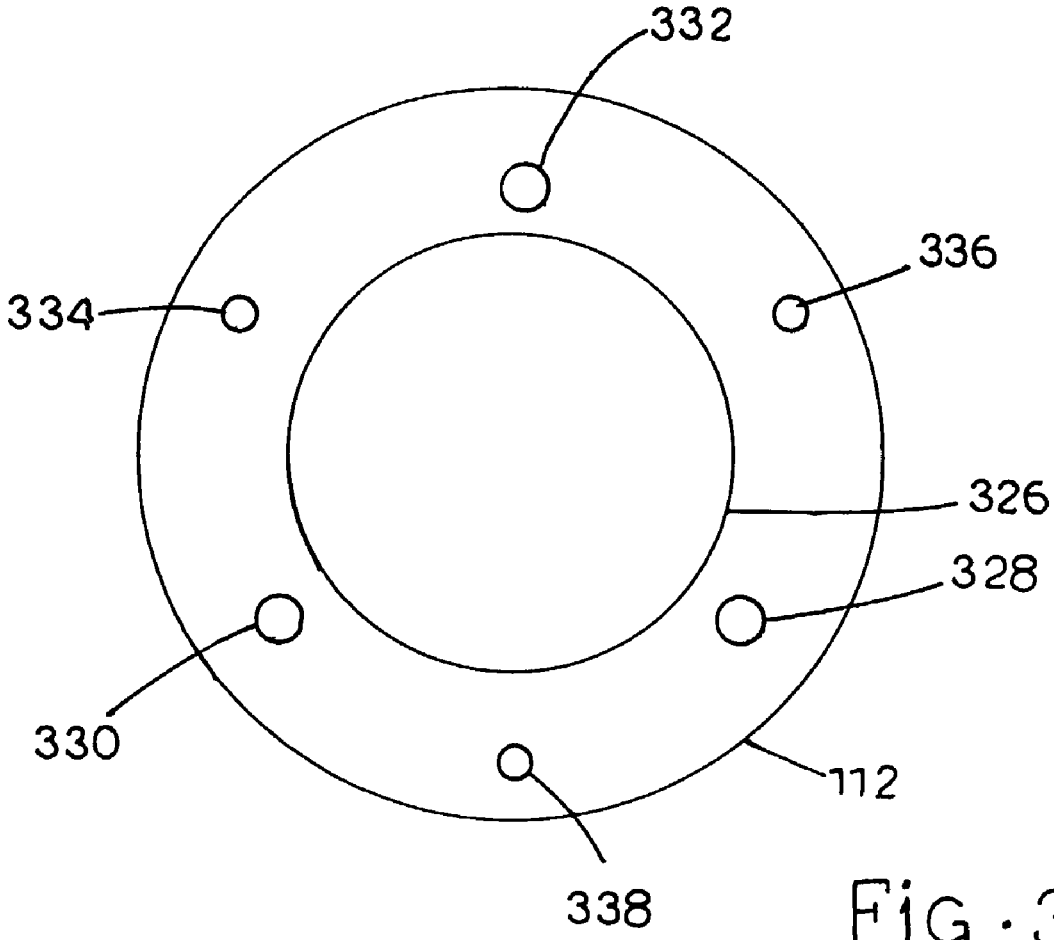
FIG. 3H is a top plan view of the endcap electrode of FIG. 3G.

FIGS. 3G and 3H illustrate a vertical side view and a top plan view, respectively, of endcap electrode 112. Endcap electrode 114 can have the same dimensions and shape as endcap electrode 112. Endcap electrode 112 can include an opening 326 for forming a portion of the interior of OIT 104. The center of opening 326 may be aligned with z axis 130 of OIT 104. Further, endcap electrode 112 can include other openings 328, 330, and 332 for receiving alignment rods. Endcap electrode 112 may also include openings 334, 336, and 338 for receiving ceramic components for holding the components of OIT 104 in place and electrically isolating the electrodes. Endcap electrode 112 can have a length (along its center axis) of 0.150 inches and a width of 2.625 inches. Further, endcap electrode 112 can be composed of stainless steel. Alternatively, endcap electrode 112 can be made of any other suitable materials and have any other suitable dimensions and shapes.

Figure 4:
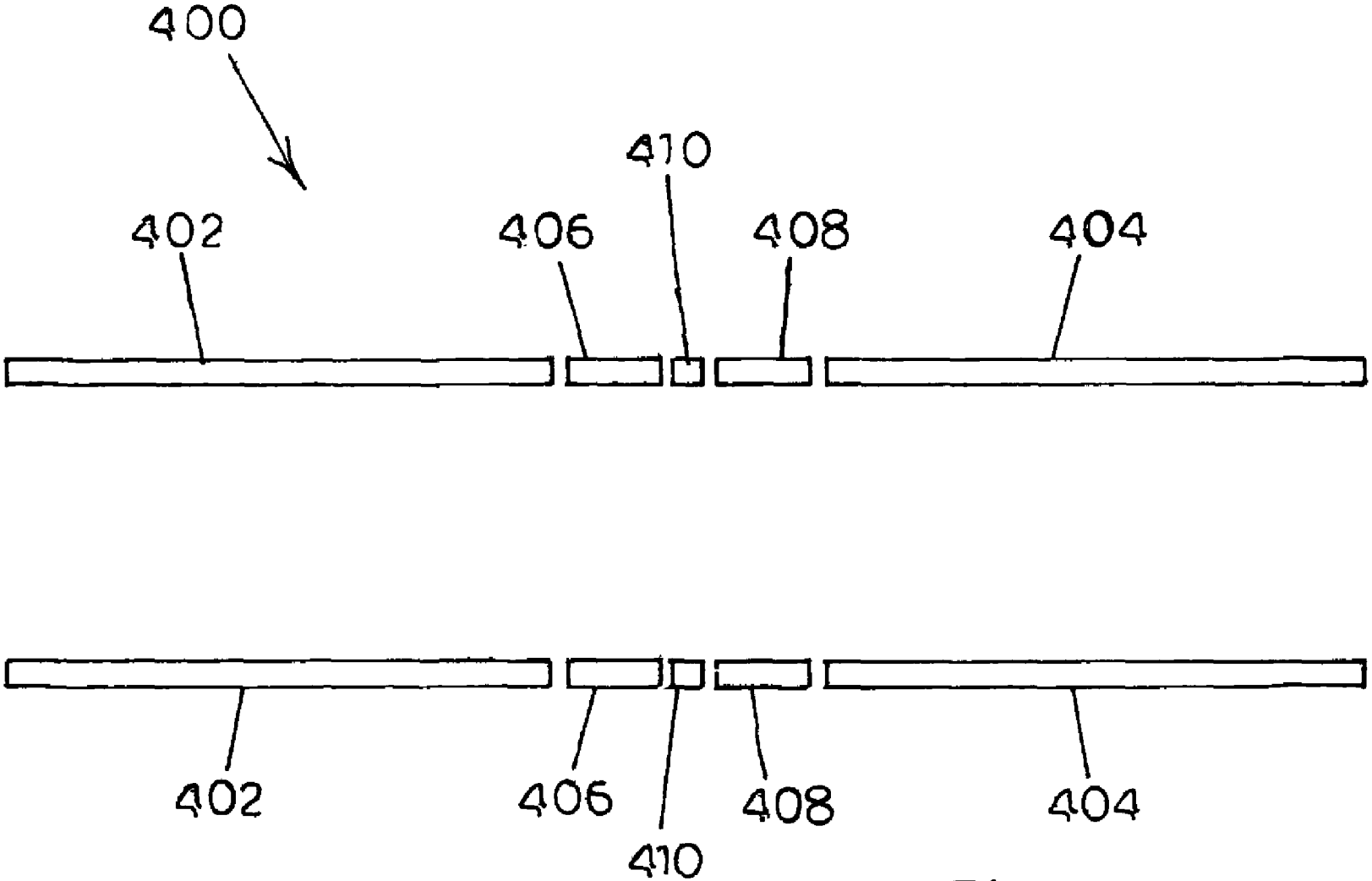
FIG. 4 is a cross-sectional side view of another exemplary OIT according to an embodiment of the subject matter described herein.

FIG. 4 illustrates a vertical cross-sectional side view of another exemplary OIT, generally designated 400, according to an embodiment of the subject matter described herein. Referring to FIG. 4, OIT 400 can include endcap electrodes 402 and 404, outer ring electrodes 406 and 408, and a central ring electrode 410. Similar to the embodiment of OIT 104 shown in FIG. 1, endcap electrodes 402 and 404, outer ring electrodes 406 and 408, and central ring electrode 410 can be used for generating a substantially octapole electric field by application of an RF voltage. According to one embodiment, endcap electrodes 402 and 404 have a length between about 3 and 5 times the radius of the ion trap volume for allowing the ions to interact with a uniform electric field as the ions approach the entrance of endcap electrode 402 or exit through endcap electrode 404. Additionally, the ratio of the length of outer ring electrodes 406 and 408 to the length of central ring electrode 410 can be different from the ratio of the length of outer ring electrodes 116 and 118 to the length of central ring electrode 120. The ratio of the lengths of electrodes 406 and 408 to the length of central ring electrode 410 can be approximately 3.3 but can also range from 0.05 to 10. In one respect, OIT 400 of FIG. 4 is differentiated from OIT 104 of FIG. 1 by the length of endcap electrodes 402 and 404 in comparison to endcap electrodes 110 and 112. Endcap electrodes 402 and 404 are significantly greater in length than endcap electrodes 110 and 112. For example, endcap electrodes 402 and 404 can have a length ranging between two and ten times its inner diameter, whereas endcap electrodes 110 and 112 can have a length ranging between 0.1 and 0.5 times the inner diameter of one of outer ring electrodes 116 and 118. By utilizing longer endcap electrodes, the truncation of the electric fields at the endcap electrodes can be reduced. Further, the fringe fields that would effect ions upon entry and exiting the ion trap can be reduced.

Referring again to FIG. 1, computer 108 can execute instructions to control RF signal supply 128 to apply an RF voltage to outer ring electrodes 116 and 118 for generating a substantially octapole electric field within OIT 104. In addition, computer 108 can execute instructions for controlling ion source 102 to produce ions and direct the ions into OIT 104. Computer 108 can also control detector 106 to receive ions ejected from OIT 104 and communicate the output signal to computer 108 for storage, analysis, and display to an operator. Computer 108 can be a conventional computer including a display, user interface such as a keyboard, a processor, and memory for storing computer-executable instructions for implementing the processes described herein and for storing data acquired from detector 106. The computer-executable instructions can embodied in a computer readable medium accessible by computer 108. Exemplary computer-readable media suitable for storing instructions to implement the subject matter described herein include chip memory devices, optical disks, magnetic disks, downloadable electrical signals, application-specific integrated circuits, programmable logic devices, or any other medium capable of storing computer-executable instructions.

As described herein, RF signal supply 128 can apply an RF voltage to either outer ring electrodes 116 and 118 or endcap electrodes 112 and 114 for producing a substantially octapolar electric field within OIT 104. The voltage range applied by the RF signal supply can depend on the particular OIT used. For example, voltages in the range of 50 volts to 30,000 volts. However, it should be noted that the RF signal supply can apply any voltage or voltage range appropriate for the particular embodiment in which it is being used. The applied RF voltage can be characterized by the following equation (wherein V(t) is the voltage for time t, the angular frequency is Ω, the phase is ϕ, and the maximum amplitude of the RF voltage is $V_0$):

$$V(t)=V_0 \sin(\Omega t+\phi)$$

The frequency of the RF voltage can range from 300 kHz to 3 MHz.

Ion source 102 can produce ions though electrospray ionization (ESI), nanoelectrospray ionization (nESI), matrix assisted laser desorption ionization (MALDI), electron impact ionization (EI) or other suitable methods for producing ions. Alternatively, electrons can be injected into OIT 104 for causing ionization of gaseous species present therein.

Detector 106 can be any suitable device capable of detecting ions. Suitable detectors include, but are not limited to, Faraday cups, CHANNELTRON®) detectors (available from Burle Industries, Inc. of Lancaster, Pa., U.S.A.), electron photo multipliers, array detectors, and micro channel plates.

METHODS OF USE

Figure 5:
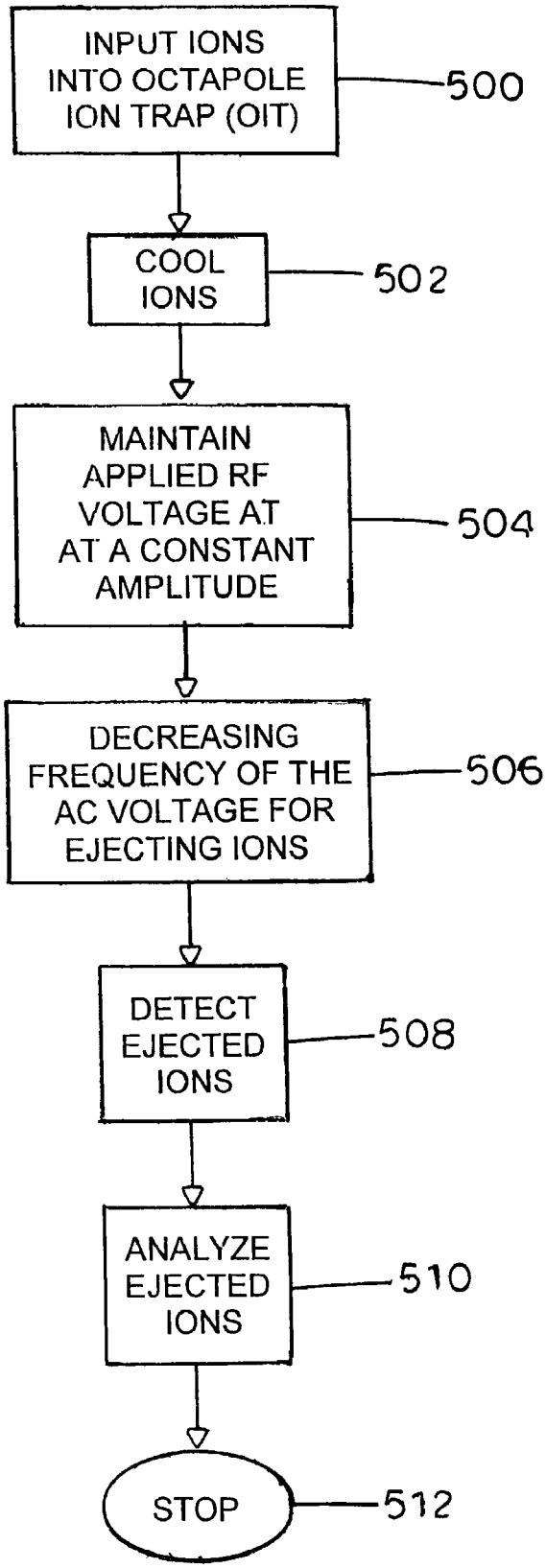
FIG. 5 is a flow chart of an exemplary process for utilizing a mass spectrometer for implementing mass selective resonance ejection according to one embodiment of the subject matter described herein.

FIG. 5 illustrates a flow chart of an exemplary process for utilizing a mass spectrometer for implementing mass selective resonance ejection according to one embodiment of the subject matter described herein. The process of FIG. 5 is described with respect to mass spectrometer 100 of FIG. 1 and, in the alternative, mass spectrometer 200 of FIG. 2. Alternatively, any of the different embodiments and variations of the mass spectrometers described herein may be utilized for implementing the process of FIG. 5.

Referring to step 500 of FIG. 5, ions may be input into trapping volume 110 of OIT 104. The ions may be input by ionizing molecules in volume 110 of OIT 104. Alternatively, externally-generated ions may be focused or injected into volume 110. Further, in mass spectrometer 100 of FIG. 1, the externally-generated ions may be gated or input into OIT 104 by application of suitable voltages to a lens system (generally designated 138) that receives and focuses ions emitted from ion source 102. Alternatively, in mass spectrometer 200 of FIG. 2, the ions may be input into OIT 104 by application of suitable voltages to a lens system 138.

Next, at step 502, the ions may be allowed to kinetically cool for a period of time through collisions with a bath gas such as helium (He), argon (Ar), air or other suitable monoatomic or small polyatomic species.

Next, steps 504 and 506 can be performed for ejecting ions from OIT 104 in order of increasing mass-to-charge ratio (m/z). Referring to step 504, in mass spectrometer 100 of FIG. 1, the RF voltage applied to outer ring electrodes 116 and 118 is maintained at constant amplitude. Alternatively, in step 504 for mass spectrometer 200 of FIG. 2, the RF voltage applied to central ring electrode 120 and endcap electrodes 112 and 114 is maintained at constant amplitude.

Next, regarding mass spectrometer 100 of FIG. 1, a supplemental AC voltage can be applied to endcap electrodes 112 and 114. Alternatively, the AC voltage can be applied to central ring electrode 120 and one of endcap electrode 112 or endcap electrode 114. The AC voltage applied to the endcap electrodes and central ring electrode can be characterized by the following equation (wherein V(t) is the voltage for time t, the angular frequency is ω, the phase is ϕ, and the maximum amplitude of the RF voltage is $V_0$):

$$V(t)=V_0 \sin(\omega t+\phi)$$

The amplitude of the AC voltage depends on whether ions are being ejected from the ion trap or being excited for tandem mass spectrometry. The amplitude of the AC voltage can range from 10 mV to 100V. Alternatively, regarding mass spectrometer 200 of FIG. 2, the supplemental AC voltage can be applied to outer ring electrodes 116 and 118. At step 506, the frequency of the supplemental AC voltage is decreased from an initial frequency for ejecting trapped ions according to increasing mass-to-charge ratio. A trapped ion is ejected when the secular frequency of the ion becomes equal to the frequency of the applied supplemental AC voltage.

At step 508 of FIG. 5, the ejected ions can be detected by detector 106, which can produce an output signal. The resulting output signal can be received by computer 108 and analyzed at step 510. Next, the process can stop at step 512. Therefore, by implementing the process of FIG. 5, ions can be ejected according to a mass-to-charge ratio and analyzed. The results of the analysis can then be available for display to an operator.

Figure 6:
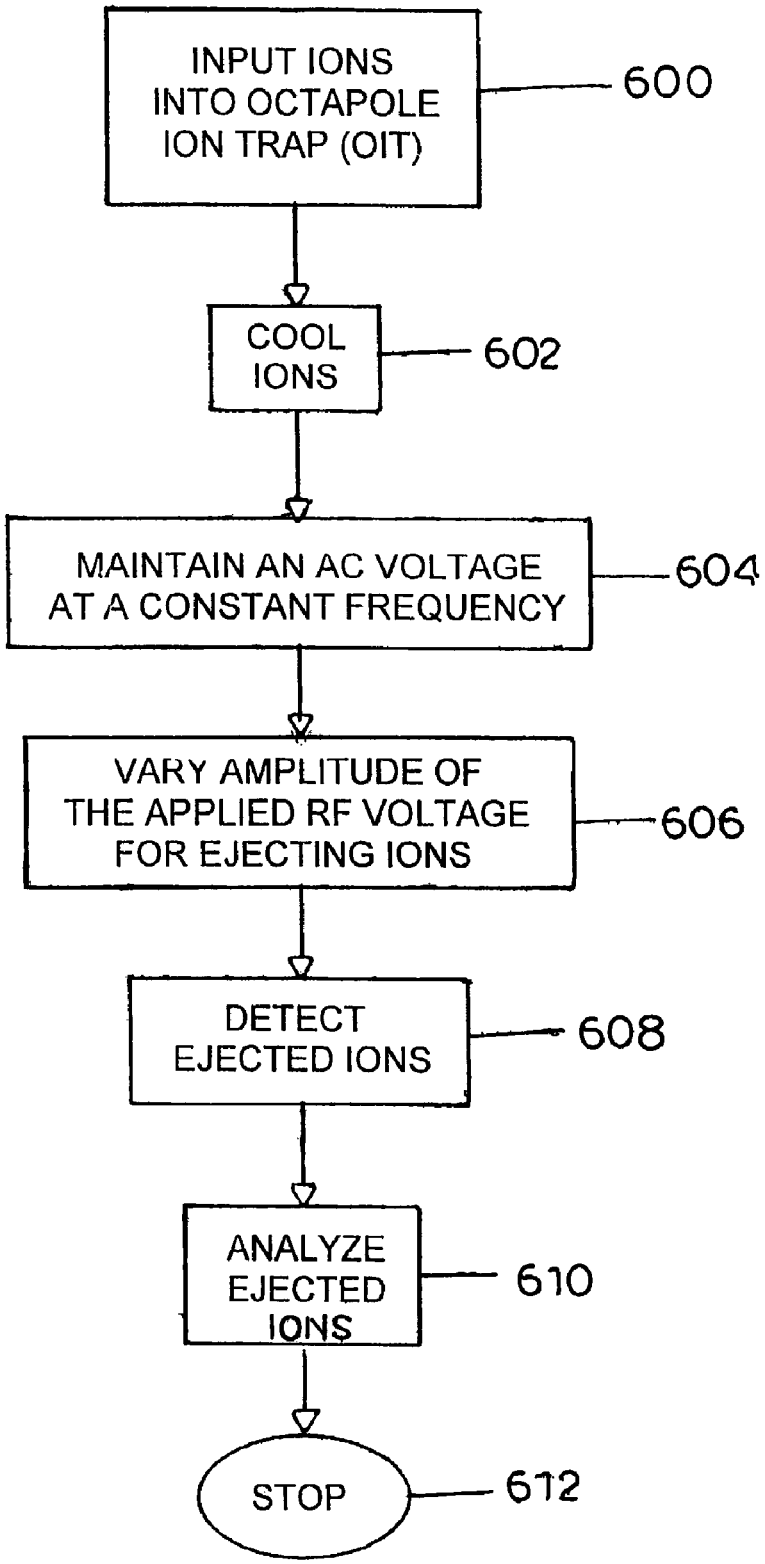
FIG. 6 is a flow chart of another exemplary process for utilizing a mass spectrometer for implementing mass selective resonance ejection according to one embodiment of the subject matter described herein.

FIG. 6 illustrates a flow chart of another exemplary process for utilizing a mass spectrometer for implementing mass selective resonance ejection according to one embodiment of the subject matter described herein. Referring to step 600 of FIG. 6, ions may be input into trapping volume 110 of OIT 104. Next, at step 602, the ions may be allowed to kinetically cool for a period of time through collisions with a bath gas.

Next, steps 604 and 606 can be performed for ejecting ions from OIT 104 in order of increasing mass-to-charge ratio (m/z). Referring to step 604, in mass spectrometer 100 of FIG. 1, a supplemental AC voltage can be applied to endcap electrodes 112 and 114 and maintained at a constant frequency. Alternatively, in mass spectrometer 100 of FIG. 1, the supplemental AC voltage can be applied to central ring electrode 120 and one of endcap electrode 112 or end cap electrode 114 and maintained at a constant frequency. Alternatively, regarding mass spectrometer 200 of FIG. 2, the supplemental AC voltage can be applied to outer ring electrodes 116 and 118 and maintained at a constant frequency.

Next, at step 606 of FIG. 6, regarding mass spectrometer 100 of FIG. 1, the amplitude of the RF voltage applied to outer ring electrodes 116 and 118 can be varied for ejecting ions. Alternatively, regarding mass spectrometer 200 of FIG. 2, the amplitude of the RF voltage applied to central ring electrode 120 and endcap electrodes 112 and 114 can be varied for ejecting ions. In particular, the RF voltage can be increased for ejecting ions in order of increasing mass-to-charge ratio. Conversely, the RF voltage can be decreased for ejecting ions in order of decreasing mass-to-charge ratio.

At step 608 of FIG. 6, the ejected ions can be detected by detector 106, which can produce an output signal. The resulting output signal can be received by computer 108 and analyzed at step 610. Next, the process can stop at step 612. Therefore, by implementing the process of FIG. 6, ions can be ejected according to a mass-to-charge ratio and analyzed.

Figure 7:
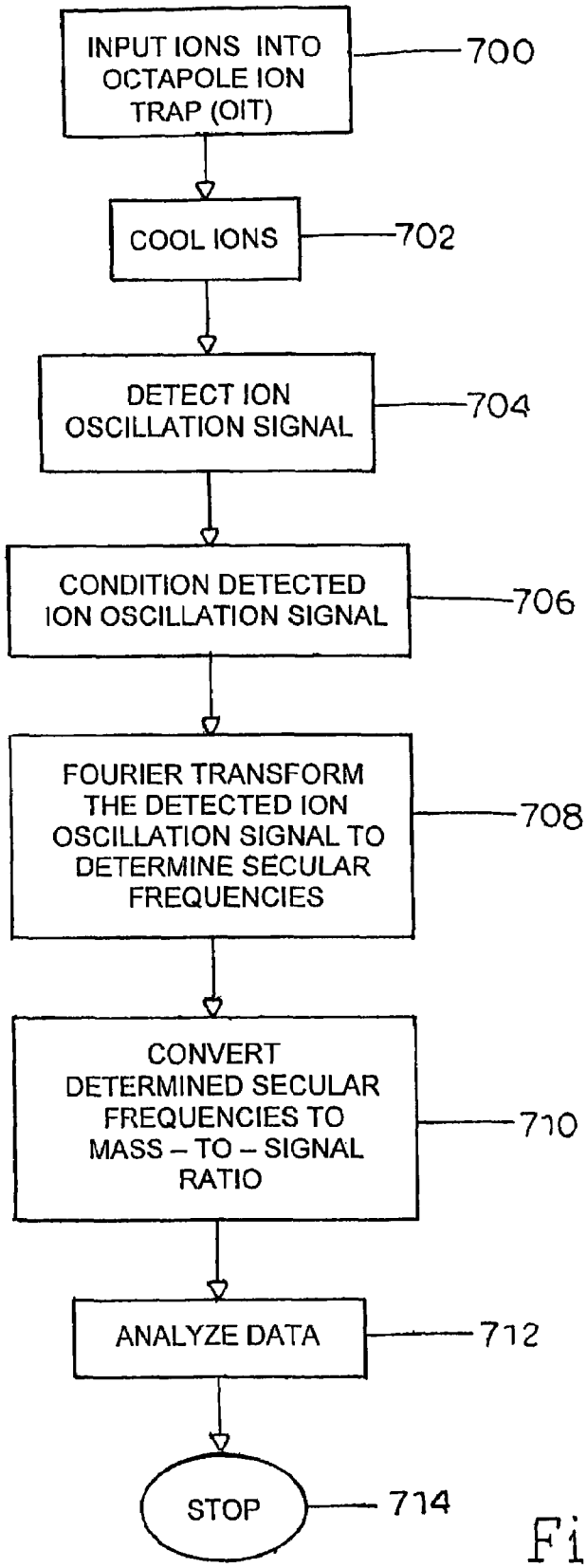
FIG. 7 is a flow chart of an exemplary process for utilizing a mass spectrometer for implementing in-situ Fourier transform ion detection according to one embodiment of the subject matter described herein.

FIG. 7 illustrates a flow chart of an exemplary process for utilizing a mass spectrometer for implementing in-situ Fourier transform ion detection according to one embodiment of the subject matter described herein. The process of FIG. 7 is described with respect to mass spectrometer 100 of FIG. 1 and, in the alternative, mass spectrometer 200 of FIG. 2. Alternatively, any of the different embodiments and variations of the mass spectrometers described herein may be utilized for implementing the process of FIG. 7.

Referring to step 700 of FIG. 7, ions may be input into trapping volume 110 of OIT 104. Next, at step 702, the ions may be allowed to kinetically cool for a period of time through collisions with a bath gas.

Next, at step 704, the ion oscillation signal of the trapped ions within OIT 104 can be detected from the induced charge resulting from ion oscillation. The ion oscillation signal may be a current signal corresponding to the ion oscillation. In mass spectrometer 100 of FIG. 1, the ion oscillation signal can be detected by the current through the grounded central ring electrode 120. In mass spectrometer 200 of FIG. 2, the ion oscillation signal can be detected by the current through the grounded outer ring electrodes 116 and 118. The ion oscillation signal may be a time-based signal.

Next, at step 706, the detected ion oscillation signal can be conditioned. For example, a detected ion oscillation current can be converted to a voltage signal corresponding to the ion oscillation. Further, the voltage signal can be amplified. The ion oscillation signal may also contain unwanted frequency components which can be filtered.

At step 708 of FIG. 7, the ion oscillation signal can be Fourier-transformed for determining the secular frequencies of ions. The determined secular frequencies may then be converted to a mass-to-charge ratio (step 710). At step 712, the resulting data can be analyzed by computer 108 and displayed to an operator. Next, the process can stop at step 714.

Figure 8:
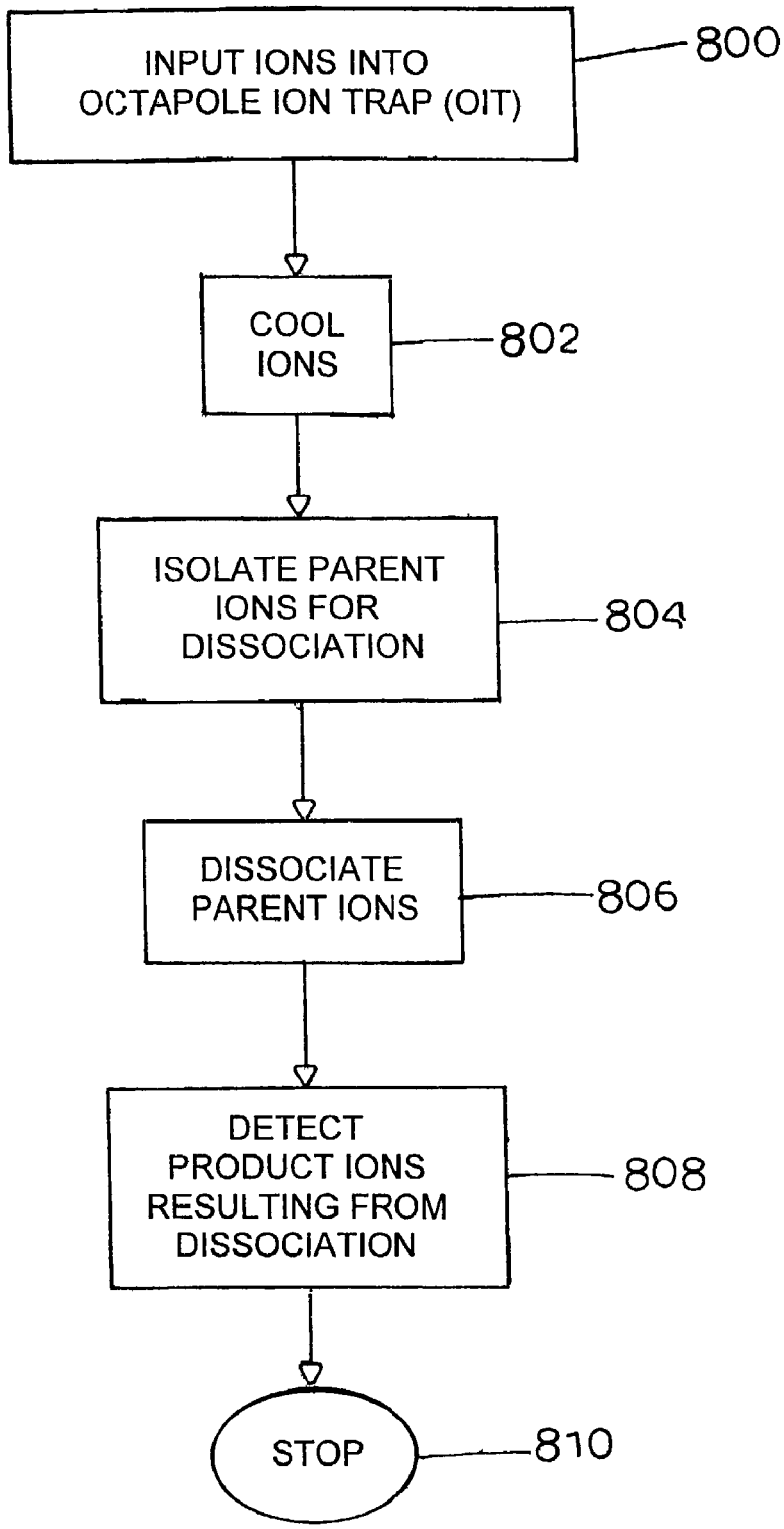
FIG. 8 is a flow chart of an exemplary process for utilizing a mass spectrometer for implementing MS/MS analysis, or tandem analysis, with a mass spectrometer according to an embodiment of the subject matter described herein.

FIG. 8 illustrates a flow chart of an exemplary process for utilizing a mass spectrometer for implementing MS/MS analysis, or tandem analysis, with a mass spectrometer according to an embodiment of the subject matter described herein. Similar to the processes of FIGS. 6 and 7, the process of FIG. 8 is described with respect to mass spectrometer 100 of FIG. 1 and, in the alternative, mass spectrometer 200 of FIG. 2. Alternatively, any of the different embodiments and variations of the mass spectrometers described herein may be utilized for implementing the process of FIG. 8.

Referring to step 800 of FIG. 8, ions may be input into trapping volume 110 of OIT 104. Next, at step 802, the ions may be allowed to kinetically cool for a period of time through collisions with a bath gas.

Next, at step 804, ions of the mass-to-charge ratio to be dissociated (i.e., parent ions) can be isolated by resonantly ejecting all of the other ions. Resonance ejection may be implemented by sweeping the resonance ejection voltage frequency or by applying a broadband waveform (i.e., a waveform containing the frequencies of all of the ions to be ejected) to endcap electrodes 112 and 114 of mass spectrometer 100 (FIG. 1) or outer ring electrodes 116 and 118 of mass spectrometer 200 (FIG. 2).

Referring to step 806 of FIG. 8, parent ions can be dissociated. Techniques for dissociating the parent ions can include collision induced dissociation (CID), infrared multiphoton photodissociation (IRMPD), photodissociation using ultraviolet (UV) or visible (Vis) wavelength photons, electron capture dissociation (ECD), and electron transfer dissociation (ETD). CID includes colliding parent ions with gas atoms or molecules in order to dissociate the parent ions. For implementing CID in mass spectrometer 100 of FIG. 1, ions can be kinetically excited by applying a supplemental AC voltage to endcap electrodes 112 and 114 with a frequency equal to the secular frequency. For implementing CID in mass spectrometer 200 of FIG. 2, ions can be kinetically excited by applying the supplemental AC voltage to outer ring electrodes 116 and 118.

IRMPD can be implemented by irradiating the parent ions for a period of time with the output of a $CO_2$ laser or other suitable source of infrared radiation.

Photodissociation with UV or Vis photons can be implemented by irradiating the parent ions with the output of a suitable photon source. One example of such a photon source is the frequency-tripled or quadrupled output of a Nd:YAG laser.

ECD can be implemented by injecting low energy electrons into OIT 104 with the positive, multiply-charged parent ions capturing low energy electrons, which leads to the subsequent dissociation of the ions.

ETD can be implemented by injecting negatively charged reagent ions into OIT 104 to react with positive, multiply-charged analyte ions, which leads to the subsequent dissociation of the positive ions.

Next, at step 808, product ions are detected resulting from the dissociation of step 806. The product ions can be detected by any suitable detection method such as the detection methods described herein. The process can then stop at step 810.

Multiple stages of MS/MS can be performed by returning to step 804 after step 806. The product ions generated in the first implementation of step 806 become the parent ions ($2^{nd}$ generation parent ions) for the second implementation of step 804. After the second implementation of step 806 the product ions ($2^{nd}$ generation product ions) can be detected in step 808 and the process stopped at step 810. Alternatively, step 804 can be implemented again with the $2^{nd}$ generation product ions becoming the $3^{rd}$ generation parent ions.

Figure 9:
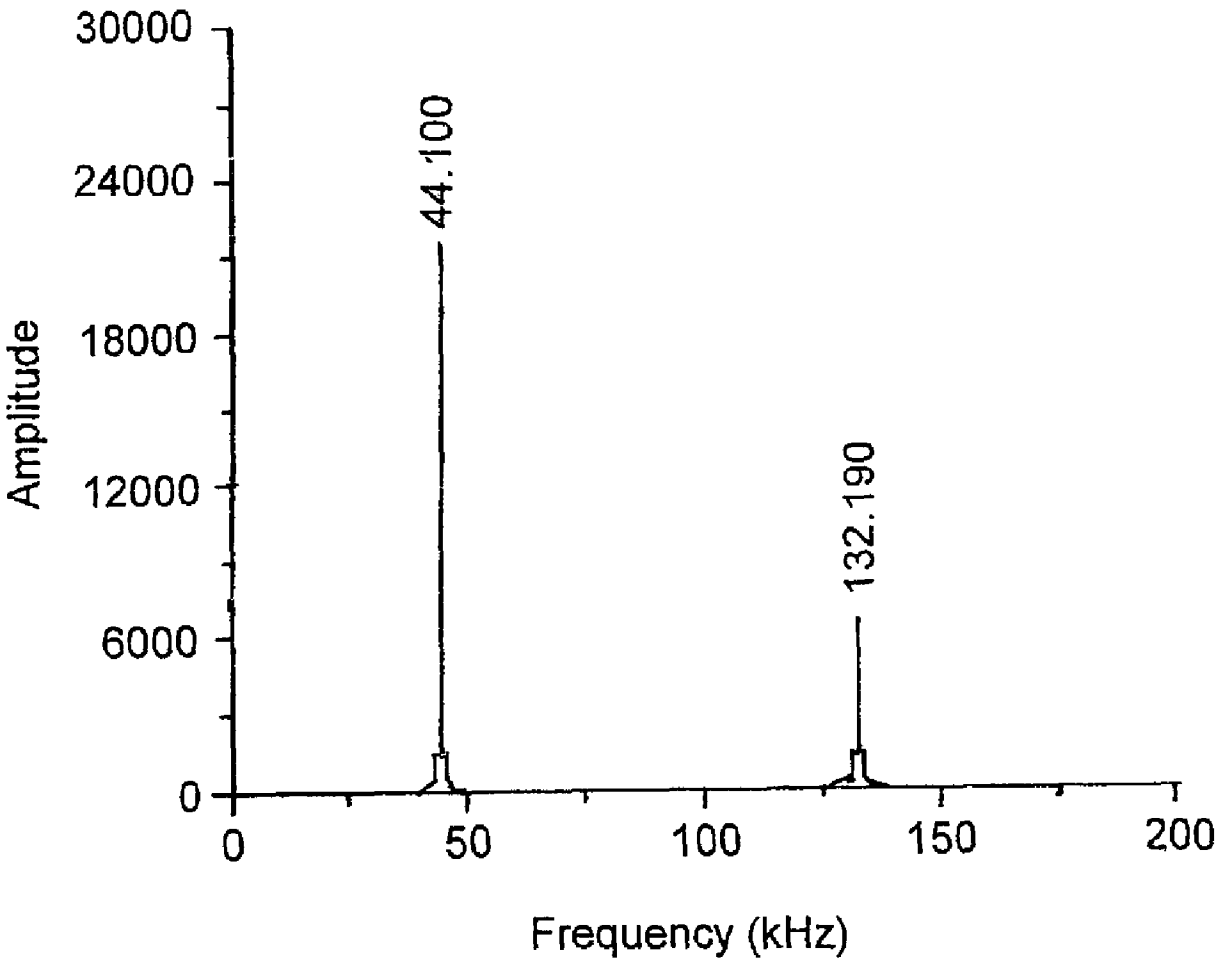
FIG. 9 is a graph of the Fourier-transformed data for the exemplary OIT of FIG. 4.

Experimentation and modeling have been performed for some of the embodiments of the mass spectrometers described herein. In particular, in-situ Fourier transform experiments were modeled with OIT 400 of FIG. 4. In OIT 400, 4 kV was applied to central ring electrode 410 and endcap electrodes 402 and 404, while outer ring electrodes 406 and 408 were grounded. Ions of mass-to-charge ratio m/z 500 were trapped for 50 milliseconds and their x, y, and z positions were monitored during the ion trajectory simulation. A pressure model was included to simulate a helium (He) bath gas at a mean free path of 40 mm that results in about 6 collisions every millisecond. The ions' distance from the outer ring electrodes was calculated following the simulation experiment. The reciprocal of the distance was taken to simulate the decrease in ion current that can be expected during an image current detection experiment. This reciprocal distance of the ion as a function of time was Fourier transformed to determine the secular frequency of the ion. FIG. 9 illustrates a graph of the Fourier-transformed data. The secular frequency of the 500 m/z ion was observed at 44.1 kHz and first odd harmonic was also observed at reduced amplitude. The amplitude of the RF voltage was altered and the resultant frequency was found to scale appropriately with the increase in the RF voltage.

It will be understood that various details of the subject matter described herein may be changed without departing from the scope of the subject matter described herein. Furthermore, the foregoing description is for the purpose of illustration only, and not for the purpose of limitation, as the subject matter described herein is defined by the claims as set forth hereinafter.

What is claimed is:

1. A mass spectrometer comprising:

(a) a first endcap electrode;

(b) a first outer ring electrode positioned downstream of the first endcap electrode;

(c) a central ring electrode positioned downstream of the first outer ring electrode;

(d) a second outer ring electrode positioned downstream of the central ring electrode;

(e) a second endcap electrode positioned downstream of the second outer ring electrode; and (f) a radio frequency (RF) signal supply operable to apply an RF signal to the first and second outer ring electrodes to thereby generate a substantially octapolar field for trapping charged particles.

2. The mass spectrometer according to claim 1 wherein the central ring electrode and the first and second endcap electrodes are connected to a ground.

3. The mass spectrometer according to claim 1 wherein each of the first and second endcap electrodes define an opening for allowing charged particles to pass through the opening.

4. The mass spectrometer according to claim 1 wherein each of the first and second endcap electrodes have a length between about 3 and 5 times a radius of the endcap electrodes.

5. The mass spectrometer according to claim 1 wherein each of the first and second endcap electrodes are cylindrical in shape and define an opening for allowing charged particles to pass through the opening.

6. The mass spectrometer according to one of claims 3, 4, and 5 comprising a mesh attached to the first and second endcap electrodes and positioned to cover the openings of the first and second endcap electrodes.

7. The mass spectrometer according to claim 1 wherein each of the first and second outer ring electrodes define an opening for allowing charged particles to pass through the opening.

8. The mass spectrometer according to claim 1 wherein each of the first and second outer ring electrodes are cylindrical in shape and define an opening for allowing charged particles to pass through the opening.

9. The mass spectrometer according to claim 1 wherein the central ring electrode defines an opening for allowing charged particles to pass through the opening.

10. The mass spectrometer according to claim 1 wherein the central ring electrode is cylindrical in shape and defines an opening for allowing charged particles to pass through the opening.

11. The mass spectrometer according to claim 1 wherein an inner surface of at least one of the electrodes is hyperbolic in shape.

12. The mass spectrometer according to claim 1 wherein the first and second outer ring electrodes, the central ring electrode, and the endcap electrodes define an interior wherein the substantially octapolar field is generated for trapping charged particles.

13. The mass spectrometer according to claim 12 wherein the RF signal is an RF voltage.

14. The mass spectrometer according to claim 13 wherein the RF voltage is between about 50 and 30,000 volts.

15. The mass spectrometer according to claim 1 comprising an ion source positioned upstream from the first endcap electrode, wherein the ion source is operable to direct ions in a downstream direction.

16. The mass spectrometer according to claim 1 comprising an alternating current (AC) circuit connected to at least one of the first and second endcap electrodes, and the AC circuit being operable to generate an AC signal for ejecting charged particles that are trapped in the substantially octapolar field.

17. The mass spectrometer according to claim 16 wherein the AC circuit is connected to the central ring electrode to apply the AC signal to the central ring electrode for ejecting the charged particles.

18. The mass spectrometer according to claim 16 comprising a detector positioned downstream from the second endcap electrode, wherein the ion source is operable to detect the charged particles ejected from the substantially octapolar field.

19. The mass spectrometer according to claim 18 wherein the detector is operable to generate an output signal based on the detected charged particles, and the mass spectrometer comprises a computer operable to receive and analyze the output signal.

20. The mass spectrometer according to claim 1 comprising a computer operable to control the RF signal supply to apply the RF signal.

21. A method of mass spectrometry, the method comprising:

(a) providing a mass spectrometer comprising:
  (i) a first endcap electrode;
  (ii) a first outer ring electrode positioned downstream of the first endcap electrode;
  (iii) a central ring electrode positioned downstream of the first outer ring electrode;
  (iv) a second outer ring electrode positioned downstream of the central ring electrode; and
  (v) a second endcap electrode positioned downstream of the second outer ring electrode; and
(b) applying a radio frequency (RF) signal to the first and second outer ring electrodes to thereby generate a substantially octapolar field for trapping charged particles.

22. The method according to claim 21 wherein the central ring electrode and the first and second endcap electrodes are connected to a ground.

23. The method according to claim 21 wherein each of the first and second endcap electrodes define an opening for allowing charged particles to pass through the opening.

24. The method according to claim 21 wherein each of the first and second endcap electrodes have a length between about 3 and 5 times a radius of the endcap electrodes.

25. The method according to claim 21 wherein each of the first and second endcap electrodes are cylindrical in shape and define an opening for allowing charged particles to pass through the opening.

26. The method according to one of claims 23, 24, and 25 wherein the mass spectrometer comprises a mesh attached to the first and second endcap electrodes and positioned to cover the openings of the first and second endcap electrodes.

27. The method according to claim 21 wherein each of the first and second outer ring electrodes define an opening for allowing charged particles to pass through the opening.

28. The method according to claim 21 wherein each of the first and second outer ring electrodes are cylindrical in shape and define an opening for allowing charged particles to pass through the opening.

29. The method according to claim 21 wherein the central ring electrode defines an opening for allowing charged particles to pass through the opening.

30. The method according to claim 21 wherein the central ring electrode is cylindrical in shape and defines an opening for allowing charged particles to pass through the opening.

31. The method according to claim 21 wherein an inner surface of at least one of the electrodes is hyperbolic in shape.

32. The method according to claim 21 wherein the first and second outer ring electrodes, the central ring electrode, and the endcap electrodes define an interior wherein the substantially octapolar field is generated for trapping charged particles.

33. The method according to claim 21 wherein applying the RF signal includes applying an RF voltage to the first and second outer ring electrodes.

34. The method according to claim 33 wherein the RF voltage is between about 50 and 30,000 volts.

35. The method according to claim 21 comprising directing ions into the substantially octapolar field.

36. The method according to claim 21 comprising applying an alternating current (AC) signal to at least one of the first and second endcap electrodes for ejecting charged particles that are trapped in the substantially octapolar field.

37. The method according to claim 36 wherein applying the AC signal includes applying the AC signal to the central ring electrode for ejecting the charged particles.

38. The method according to claim 36 comprising detecting the charged particles ejected from the substantially octapolar field.

39. The method according to claim 38 comprising analyzing the detected charged particles.

40. The method according to claim 21 comprising ejecting charged particles trapped in the substantially octapolar field based on mass-to-charge ratios of the charged particles.

41. The method according to claim 40 wherein ejecting the trapped charged particles includes applying an alternating current (AC) signal having a frequency to at least one of the first and second endcap electrodes and decreasing the frequency of the AC signal over a period of time.

42. The method according to claim 41 wherein ejecting the trapped charged particles includes applying the AC signal to the central ring electrode and decreasing the frequency of the AC signal over the period of time.

43. The method according to claim 41 wherein ejecting the trapped charged particles includes maintaining the applied RF signal at a predetermined amplitude.

44. The method according to claim 41 wherein ejecting the trapped charged particles includes varying the applied RF signal.

45. The method according to claim 44 comprising ejecting the trapped charged particles includes applying an alternating (AC) current signal having a predetermined frequency to at least one of the first and second endcap electrodes.

46. The method according to claim 45 wherein ejecting the trapped charged particles includes applying the AC current signal to the central ring electrode.

47. The method according to claim 21 comprising detecting current induced on the central ring electrode to generate an oscillation signal of the charged particles.

48. The method according to claim 47 comprising performing a Fourier transform on the oscillation signal.

49. The method according to claim 21 wherein the trapped charged particles include parent and non-parent ions, and wherein the method comprises ejecting the non-parent ions.

50. The method according to claim 49 comprising dissociating the parent ions for producing product ions.

51. The method according to claim 49 comprising detecting the product ions.

52. A mass spectrometer comprising:

(a) a first endcap electrode;
(b) a first outer ring electrode positioned downstream of the first endcap electrode;
(c) a central ring electrode positioned downstream of the first outer ring electrode;
(d) a second outer ring electrode positioned downstream of the central ring electrode;
(e) a second endcap electrode positioned downstream of the second outer ring electrode; and
(f) a radio frequency (RF) signal supply operable to apply an RF signal to the central ring electrode and the first and second endcap electrodes to thereby generate a substantially octapolar field for trapping charged particles.

53. The mass spectrometer according to claim 52 wherein the first and second outer ring electrodes are connected to a ground.

54. The mass spectrometer according to claim 52 wherein each of the first and second endcap electrodes define an opening for allowing charged particles to pass through the opening.

55. The mass spectrometer according to claim 52 wherein each of the first and second endcap electrodes have a length between about 3 and 5 times a radius of the endcap electrodes.

56. The mass spectrometer according to claim 52 wherein each of the first and second endcap electrodes are cylindrical in shape and define an opening for allowing charged particles to pass through the opening.

57. The mass spectrometer according to one of claims 54, 55, and 56 comprising a mesh attached to the first and second endcap electrodes and positioned to cover the openings of the first and second endcap electrodes.

58. The mass spectrometer according to claim 52 wherein each of the first and second outer ring electrodes define an opening for allowing charged particles to pass through the opening.

59. The mass spectrometer according to claim 52 wherein each of the first and second outer ring electrodes are cylindrical in shape and define an opening for allowing charged particles to pass through the opening.

60. The mass spectrometer according to claim 52 wherein the central ring electrode defines an opening for allowing charged particles to pass through the opening.

61. The mass spectrometer according to claim 52 wherein the central ring electrode is cylindrical in shape and defines an opening for allowing charged particles to pass through the opening.

62. The mass spectrometer according to claim 52 wherein an inner surface of at least one of the electrodes is hyperbolic in shape.

63. The mass spectrometer according to claim 52 wherein the first and second outer ring electrodes, the central ring electrode, and the endcap electrodes define an interior wherein the substantially octapolar field is generated for trapping charged particles.

64. The mass spectrometer according to claim 52 wherein the RF signal is an RF voltage.

65. The mass spectrometer according to claim 64 wherein the RF voltage is between about 50 and 30,000 volts.

66. The mass spectrometer according to claim 52 comprising an ion source positioned upstream from the first endcap electrode, wherein the ion source is operable to direct ions in a downstream direction.

67. The mass spectrometer according to claim 52 comprising an alternating current (AC) circuit connected to at least one of the first and second outer ring electrodes, and the AC circuit being operable to generate an AC signal for ejecting charged particles that are trapped in the substantially octapolar field.

68. The mass spectrometer according to claim 67 wherein the AC circuit is connected to the central ring electrode to apply the AC signal to the central ring electrode for ejecting the charged particles.

69. The mass spectrometer according to claim 67 comprising a detector positioned downstream from the second endcap electrode, wherein the ion source is operable to detect the ions ejected from the substantially octapolar field.

70. The mass spectrometer according to claim 69 wherein the detector is operable to generate an output signal based on the detected charged particles, and the mass spectrometer comprises a computer operable to receive and analyze the output signal.

71. The mass spectrometer according to claim 52 comprising a computer operable to control the RF signal supply to apply the RF signal.

72. A method of mass spectrometry, the method comprising:

(a) providing a mass spectrometer comprising:
  (i) a first endcap electrode;
  (ii) a first outer ring electrode positioned downstream of the first endcap electrode;
  (iii) a central ring electrode positioned downstream of the first outer ring electrode;
  (iv) a second outer ring electrode positioned downstream of the central ring electrode; and
  (v) a second endcap electrode positioned downstream of the second outer ring electrode; and (b) applying a radio frequency (RF) signal to the central ring electrode and the first and second endcap electrodes to thereby generate an substantially octapolar field for trapping charged particles.

73. The method according to claim 72 wherein the first and second outer ring electrodes are connected to a ground.

74. The method according to claim 72 wherein each of the first and second endcap electrodes define an opening for allowing charged particles to pass through the opening.

75. The method according to claim 72 wherein each of the first and second endcap electrodes have a length between about 3 and 5 times the radius of the endcap electrodes.

76. The method according to claim 72 wherein each of the first and second endcap electrodes are cylindrical in shape and define an opening for allowing charged particles to pass through the opening.

77. The method according to one of claims 74, 75, and 76 comprising a mesh attached to the first and second endcap electrodes and positioned to cover the openings of the first and second endcap electrodes.

78. The method according to claim 72 wherein each of the first and second outer ring electrodes define an opening for allowing charged particles to pass through the opening.

79. The method according to claim 72 wherein each of the first and second outer ring electrodes are cylindrical in shape and define an opening for allowing charged particles to pass through the opening.

80. The method according to claim 72 wherein the central ring electrode defines an opening for allowing charged particles to pass through the opening.

81. The method according to claim 72 wherein the central ring electrode is cylindrical in shape and defines an opening for allowing charged particles to pass through the opening.

82. The method according to claim 72 wherein an inner surface of at least one of the electrodes is hyperbolic in shape.

83. The method according to claim 72 wherein the first and second outer ring electrodes, the central ring electrode, and the endcap electrodes define an interior wherein the substantially octapolar field is generated for trapping charged particles.

84. The method according to claim 72 wherein applying the RF signal includes applying an RF voltage to the central ring electrode and the first and second endcap electrodes.

85. The method according to claim 84 wherein the RF voltage is between about 50 and 30,000 volts.

86. The method according to claim 72 comprising directing ions into the substantially octapolar field.

87. The method according to claim 72 comprising applying an alternating current (AC) signal to at least one of the first and second outer ring electrodes for ejecting charged particles that are trapped in the substantially octapolar field.

88. The method according to claim 87 wherein applying the AC signal includes applying the AC signal to the central ring electrode for ejecting the charged particles.

89. The method according to claim 87 comprising detecting the charged particles ejected from the substantially octapolar field.

90. The method according to claim 89 comprising analyzing the detected charged particles.

91. The method according to claim 72 comprising ejecting charged particles trapped in the substantially octapolar field based on mass-to-charge ratios of the charged particles.

92. The method according to claim 91 wherein ejecting the trapped charged particles includes applying an alternating current (AC) signal having a frequency to at least one of the first and second outer ring electrodes and decreasing the frequency of the AC signal over a period of time.

93. The method according to claim 92 comprising ejecting the trapped charged particles includes applying the AC signal to the central ring electrode and decreasing the frequency of the AC signal over the period of time.

94. The method according to claim 92 wherein ejecting the trapped charged particles includes maintaining the applied RF signal at a predetermined amplitude.

95. The method according to claim 91 wherein ejecting the trapped charged particles includes maintaining the applied RF signal at a predetermined amplitude.

96. The method according to claim 94 wherein ejecting the trapped charged particles includes varying the applied RF signal.

97. The method according to claim 96 ejecting the trapped charged particles includes applying an alternating (AC) current signal having a predetermined frequency to at least one of the first and second endcap electrodes.

98. The method according to claim 72 comprising detecting current of the central ring electrode to generate an oscillation signal of the charged particles.

99. The method according to claim 72 comprising performing a Fourier transform on the oscillation signal.

100. The method according to claim 72 wherein the trapped charged particles include parent and non-parent ions, and wherein the method comprises ejecting the non-parent ions.

101. The method according to claim 100 comprising dissociating the parent ions for producing product ions.

102. The method according to claim 101 comprising detecting the product ions.

* * * * *